US009909423B2

(12) United States Patent
Hoff et al.

(10) Patent No.: US 9,909,423 B2
(45) Date of Patent: Mar. 6, 2018

(54) BALANCING POCKETS

(71) Applicants: Markus Hoff, Künzelsau (DE); Katrin Bohl, Künzelsau (DE); Reinhard Strohmeier, Rot Am See (DE)

(72) Inventors: Markus Hoff, Künzelsau (DE); Katrin Bohl, Künzelsau (DE); Reinhard Strohmeier, Rot Am See (DE)

(73) Assignee: EMB-PAPST MULFINGEN GMBH & CO., KG (DE)

( * ) Notice: Subject to any disclaimer, the term of this patent is extended or adjusted under 35 U.S.C. 154(b) by 184 days.

(21) Appl. No.: 14/642,215

(22) Filed: Mar. 9, 2015

(65) Prior Publication Data

US 2015/0292331 A1 Oct. 15, 2015

(30) Foreign Application Priority Data

Apr. 11, 2014 (DE) ..... 10 2014 207 059
May 5, 2014 (DE) ..... 10 2014 208 372

(51) Int. Cl.

| | |
|---|---|
| ***F01D 5/02*** | (2006.01) |
| ***F04D 29/68*** | (2006.01) |
| ***F04D 29/30*** | (2006.01) |
| ***F04D 29/28*** | (2006.01) |
| ***F04D 29/66*** | (2006.01) |

(52) U.S. Cl.

CPC ..... *F01D 5/027* (2013.01); *F04D 29/282* (2013.01); *F04D 29/30* (2013.01); *F04D 29/662* (2013.01); *F04D 29/681* (2013.01); *F05D 2240/306* (2013.01)

(58) Field of Classification Search

CPC ..... F05D 2240/306; F04D 29/282
See application file for complete search history.

(56) References Cited

U.S. PATENT DOCUMENTS 4,165,950 A * 8/1979 Masai ..... F04D 29/282 416/178
5,591,008 A * 1/1997 Wrobel ..... F04D 29/662 416/144
6,042,335 A * 3/2000 Amr ..... F04D 29/282 415/173.1

(Continued)

FOREIGN PATENT DOCUMENTS

DE 102011000208 A1 * 7/2012 ..... F04D 29/282

OTHER PUBLICATIONS

Machine Translation of DE 102011000208 A1.*

*Primary Examiner* — Nathaniel Wiehe
*Assistant Examiner* — Elton Wong
(74) *Attorney, Agent, or Firm* — Tarolli, Sundheim, Covell & Tummino LLP

(57) ABSTRACT

The invention relates to a drum rotor wheel for a fan having bulges to accommodate balancing weights. A drum rotor wheel according to the invention has several blades that are curved forward. The blades have a leading edge and a trailing edge. A top disc and a bottom disc are provided on the drum rotor wheel. At least one blade of the drum rotor wheel has a bulge on its leading edge. This bulge minimizes the area of flow separation, as a result of which the magnitude of the flow separation is likewise minimized. In other words, due to the bulge, the efficiency of the drum rotor wheel is increased.

7 Claims, 6 Drawing Sheets

(56) References Cited

U.S. PATENT DOCUMENTS

| | | | | |
|---|---|---|---|---|
| 8,870,541 | B2 * | 10/2014 | Imahigashi | F04D 29/281 416/187 |
| 2009/0129933 | A1 * | 5/2009 | Kilian | F04D 29/30 416/241 R |
| 2011/0038743 | A1 * | 2/2011 | Yen | F04D 29/282 417/410.1 |
| 2015/0233389 | A1 * | 8/2015 | Moll | F04D 29/662 416/145 |

* cited by examiner

BALANCING POCKETS

RELATED APPLICATIONS

The present invention is claims priority from DE102014207059.7 filed 11 Apr. 2014 and DE102014208372.9 filed 5 May 2014, the entirety of both which are incorporated herein by reference.

TECHNICAL FIELD

The invention relates to a drum rotor wheel for a fan.

BACKGROUND

Drum rotor fans are radial flow machines with a rotor wheel that has numerous short blades that are curved forward. Thanks to the forward-curved blades, drum rotors reach operating points that are desirable in terms of the achievable flow rate and pressure increase in the flow medium at much lower rotational speeds than radial fans with blades that are curved backward, something that is desirable, for example, for use in air-conditioning systems. The forward curvature brings about a high level of energy transfer from the fan to the conveying fluid. Drum rotors are used with a housing that converts the high kinetic energy into pressure energy. The flow enters the fan axially, it is accelerated, and leaves the housing radially. The forward curvature of the blades is characterized by a strong flow deflection, whereby in most cases, the flow cannot follow the blade curvature, as a result of which it becomes separated or flows back. The separation bubble on the leading edge of the blades constitutes a loss area. Consequently, the efficiency of such drum rotor fans is relatively low. Nevertheless, the high power density and the small installation space that are thus needed have led to their widespread use in the heating, air-conditioning and ventilation sectors.

As a rule, rotor wheels for blowers and fans have to be balanced for practical use in order to ensure quiet, low-vibration running. For this purpose, balancing weights are arranged especially along the outer periphery.

For example, at least one counterweight can be fastened onto a radial rotor wheel arrangement with a backward-curved radial rotor wheel having a circular bottom disc and a circular top disc with a pressing plate on at least one of the two discs in the edge area of the disc. In this context, the rotor wheel can be larger because of the counterweight. For example, a two-part balancing weight can be used that has a spring clamp and an additional weight, whereby the spring clamp has a holding section for fastening onto the impeller and a receiving section to accommodate the additional weight. Such balancing weights are complex to install. In particular, it is common practice to install balancing weights manually.

The present invention is thus based on the objective of putting forward a drum rotor wheel that can be easily balanced automatically as well as manually, a process in which the efficiency of the drum rotor wheel should not be detrimentally affected.

According to the invention, this objective is achieved by a drum rotor wheel having the features of the independent claim 1. Advantageous refinements of the drum rotor wheel ensue from the subordinate claims 2 to 9.

A drum rotor wheel according to the invention has numerous short blades that are curved forward. The blades have a leading edge and a trailing edge. A top disc and a bottom disc are provided on the drum rotor wheel. At least one blade of the drum rotor wheel has a bulge on its leading edge. This bulge minimizes the area of flow separation, as a result of which the magnitude of the flow separation is likewise minimized. In other words, due to the bulge, the efficiency of the drum rotor wheel is increased.

The bulge is connected to the bottom disc. As a result, the stability of the blade that is provided with the bulge is positively influenced by the enhanced connection to the bottom disc brought about by the bulge, and the efficiency of the drum rotor wheel is not detrimentally affected.

Moreover, the bulge is provided completely in the area of flow separation. If the bulge is only located in the area of flow separation, but if it almost completely fills this area, then the eddy formation is almost completely prevented and the efficiency of the drum rotor wheel is optimized. On the other hand, the maximum cross section is available for the flow between the blades, as a result of which the flow resistance is minimized and the efficiency of the drum rotor wheel is further optimized.

In an advantageous embodiment, the bulge has at least one balancing pocket on one blade of the drum rotor wheel, and this balancing pocket extends all the way into the bottom disc and passes through it. The balancing pocket has a hollow configuration so as to accommodate a balancing weight. Since the balancing pocket extends all the way into the bottom disc and passes through it, it has an opening in the bottom disc through which a balancing weight can be placed into the balancing pocket. In particular, if the balancing pocket has an open design, a balancing weight can be placed into the balancing pocket automatically. For example, the balancing pocket can be configured in such a way that a rectangular insertable weight can be pressed into the balancing pocket with a positive fit so that the balancing procedure can be carried out. Such a design is especially well-suited for the automatic balancing of drum rotor wheels. Furthermore, material accumulation is minimized due to the hollow design of the bulge. Drum rotor wheels are normally made of plastics, especially thermoplastics, and mainly by means of injection molding. In the case of material accumulations in plastic parts produced by means of injection molding, the problem occurs that, due to the shrinkage of the plastic during the cooling phase, sink marks and/or voids occur that can weaken the mechanical stability of the molded part and can result in a contour change. Due to such a contour change, the shape of the bulge can deviate from the intended shape, as a result of which once again, dead spots can occur in the flow that can reduce the efficiency of the drum rotor wheel. This risk is markedly diminished by providing a balancing pocket in the bulge. Moreover, material is saved.

In another embodiment, the bulge is configured so as to be shorter in the axial direction x than the axial length of the blade.

In an alternative embodiment, the balancing pocket extends all the way into the top disc. Here, the bulge extends over the entire height of the blades. An appropriately enlarged balancing weight can be placed into a balancing pocket that has been enlarged in this manner, thereby increasing the balancing effect.

In an advantageous embodiment, the balancing pocket passes all the way through the top disc. In this manner, an opening in the balancing pocket is made in the top disc, so that a balancing weight can be placed into the balancing pocket. In particular, this embodiment opens up another placement possibility for a balancing weight in addition to the insertion through the bottom disc, which is advantageous for automatic balancing since this renders the insertion of a balancing weight more flexible. For example, if a balancing weight cannot be inserted through the bottom disc due to the geometric circumstances of the balancing machine, in this embodiment, as an alternative, the balancing weight can be inserted through the top disc.

In an advantageous embodiment, all of the blades have a bulge. As a result, flow separation is minimized on all of the blades, thereby further improving the efficiency of the entire drum rotor wheel. Moreover, if several bulges have balancing pockets, then the balancing quality can be improved since the placement site of a balancing weight needed for optimal balancing can be specified more precisely.

It has proven to be especially advantageous for the bulge to be provided completely in the area of flow separation. The efficiency of the drum rotor wheel is further increased by this, whereby at the same time, the flow cross section that is made available is maximized.

An additional increase in the efficiency of the drum rotor wheel can be achieved if, in the radial direction, the bulge essentially matches the shape of the area of flow separation.

In another advantageous embodiment, the top disc has an additional ring on its outside, whereby the inner contour of the additional ring has a radius-shaped area. The radius-shaped area on the inner contour of the ring allows a guided deflection of the flow and further minimizes the flow losses, as a result of which the efficiency of the drum rotor wheel is further increased.

It has also proven to be advantageous for the additional ring to have at least a second balancing pocket. In cases where a configuration of the balancing pocket on the top disc in addition to the configuration of the balancing pocket on the bottom disc is not possible, a second plane for the balancing is nevertheless obtained, as a result of which the quality of the balancing can be improved.

In another advantageous embodiment, the additional ring has a ring-shaped material recess underneath the second balancing pocket so that the material reduction contributes to improving the distortion behavior.

Additional advantages, special features and practical refinements of the invention can be gleaned from the subordinate claims and from the presentation below of preferred embodiments, making reference to the figures.

DETAILED DESCRIPTION

Figure 1:
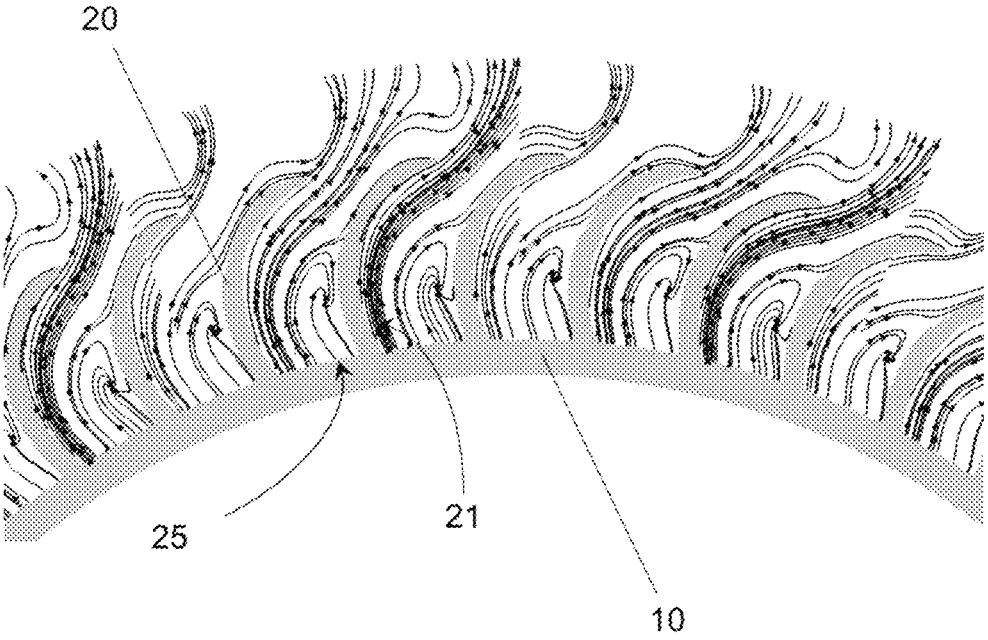
FIG. 1 flow diagram of a drum rotor wheel according to the state of the art.

FIG. 1 shows a flow diagram of a drum rotor wheel 10 according to the state of the art. The blades 20 are curved forward with a pronounced curvature. The flow cannot follow the pronounced curvature and it becomes separated on the leading edge 21 of the blades 20, so that an area 25 of flow separation is formed, whereby eddy formation occurs in this area 25, resulting in losses due to dissipation.

Figure 2:
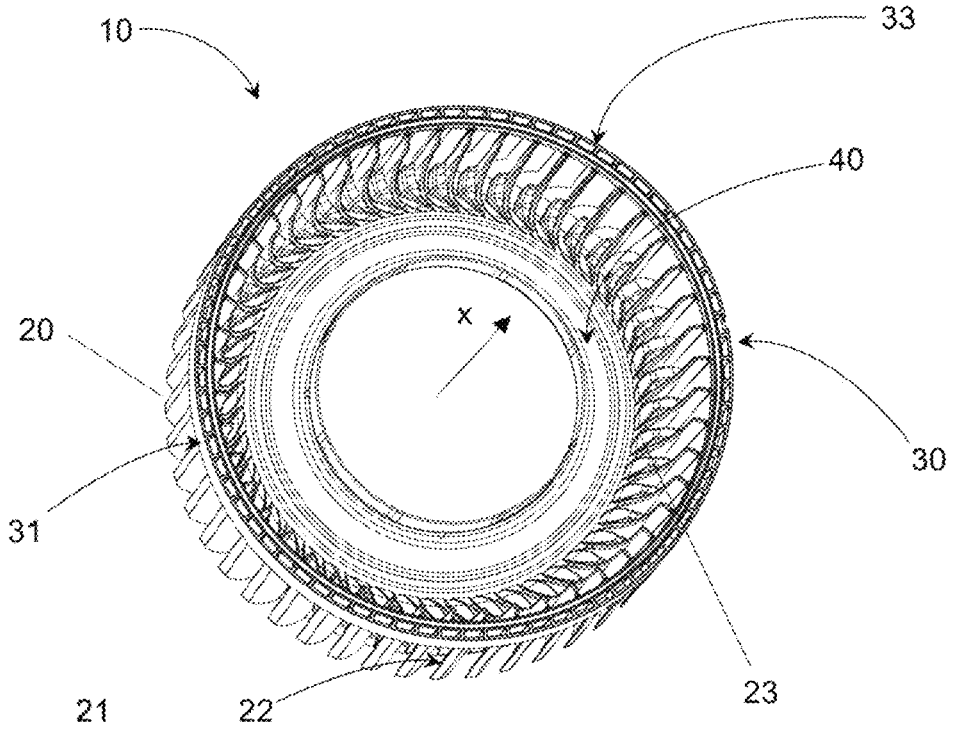
FIG. 2 the drum rotor wheel according to the invention, in a three-dimensional view as seen from the top disc.

FIG. 2 shows a drum rotor wheel 10 according to the invention in a three-dimensional view as seen from the top disc 30. The drum rotor wheel 10 has numerous short blades 20 that are curved forward. The blades 20 have a leading edge 21 and a trailing edge 22. A top disc 30 and a bottom disc 40 are provided on the drum rotor wheel 10. The blades 20 of the drum rotor wheel 10 have bulges 23 on their leading edge 21. This bulge 23 minimizes the area 25 of flow separation on each blade 20 in FIG. 1, as a result of which the total extent of flow separation is likewise minimized. The bulges 23 are connected to the bottom disc 40 and are configured so as to be shorter in the axial direction x than the axial length of the blades 20 themselves.

The top disc 30 has an additional ring 31. This additional ring 31 has second balancing pockets 33.

Figure 3:
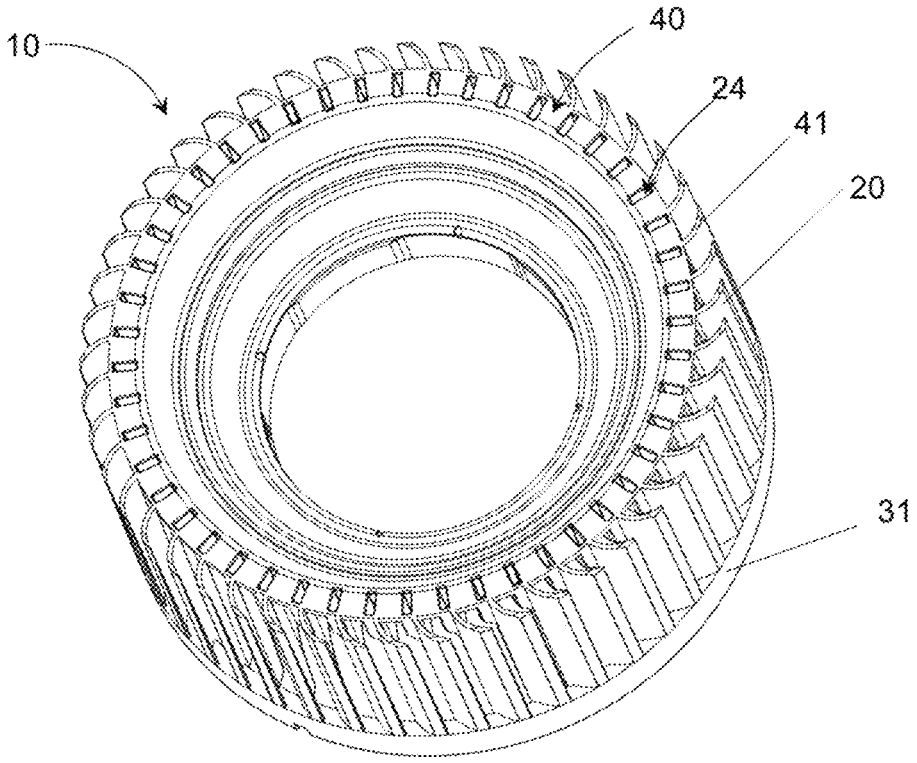
FIG. 3 the drum rotor wheel according to the invention, in a three-dimensional view as seen from the bottom disc.

FIG. 3 shows a drum rotor wheel 10 according to the invention in a three-dimensional view as seen from the bottom disc 40. The drum rotor wheel 10 is made, for example, of a thermoplastic by means of injection molding. The bulges 23 (not visible in FIG. 3) on the blades 20 of the drum rotor wheel 10 have balancing pockets 24 that extend all the way into the bottom disc 40 and pass through it. The balancing pockets 24 have a hollow configuration so that they can accommodate the balancing weights. Since the balancing pockets 24 extend all the way into the bottom disc 40 and pass through it, they have openings 41 in the bottom disc 40 through which balancing weights can be placed into the balancing pockets 24.

Figure 4:
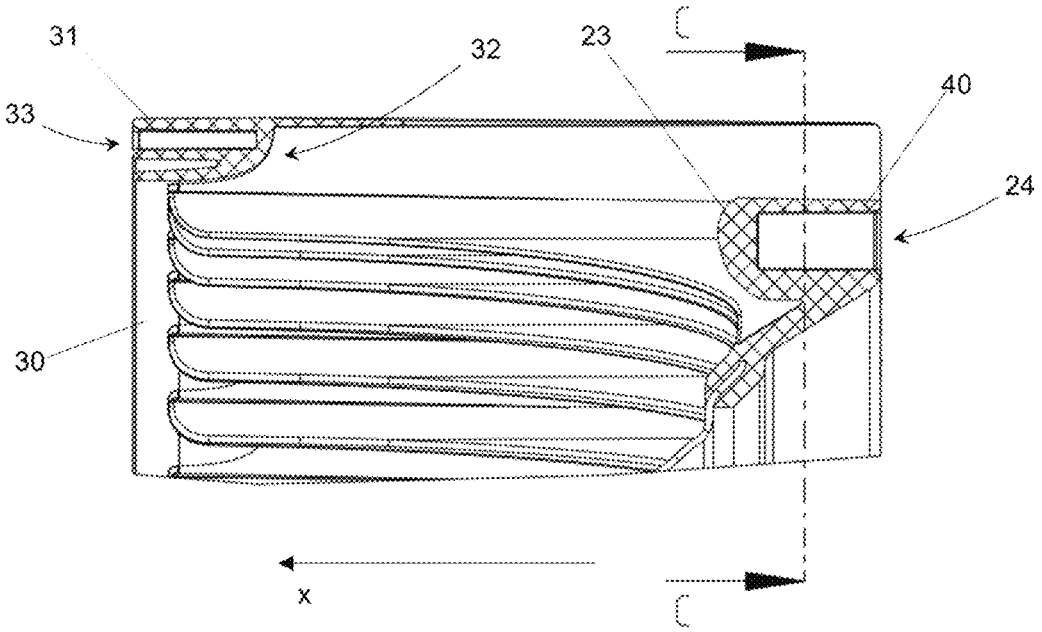
FIG. 4 the drum rotor wheel according to the invention, in a lengthwise sectional view.

FIG. 4 shows the drum rotor wheel 10 in a lengthwise sectional view. The top disc 30 has an additional ring 31. This additional ring 31 has a second balancing pocket 33. In cases in which a configuration of the balancing pocket 24 on the top disc 30 that is analogous to the configuration on the side of the bottom disc 40 is not possible, a second plane for the balancing can nevertheless be achieved with the second balancing pockets 33 in the additional ring 31, as a result of which the balancing quality can be improved. Underneath the second balancing pocket 33 in the opposite x-direction, the additional ring 31 has a ring-shaped material recess with a radius-shaped area 32. In this manner, the inlet flow is guided in such a way that no flow losses occur and the efficiency of the drum rotor wheel is further increased.

Figure 5:
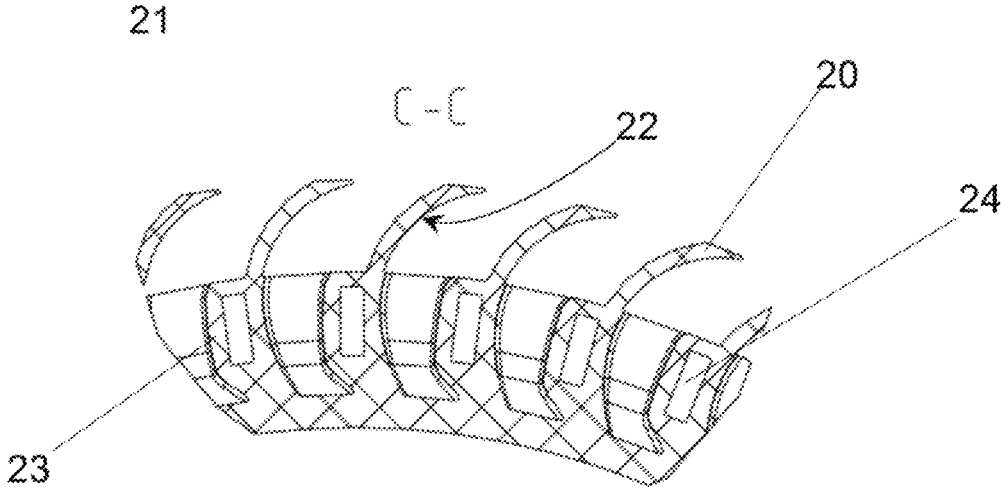
FIG. 5 section C-C through the bulges of the blades on the bottom disc of the drum rotor wheel according to the invention.

FIG. 5 shows the section C-C through the bulges 23 of the blades 20 on the bottom disc 40 of a drum rotor wheel 10. The bulges 23 have a contour that essentially corresponds to that of the area 25 of flow separation shown in FIG. 1. The balancing pockets 24 have, for example, a rectangular cross section so that appropriate rectangular balancing weights can be pressed into the balancing pockets 24 with a positive fit. Other geometries for the balancing pockets and the balancing weights are likewise possible.

Figure 6:
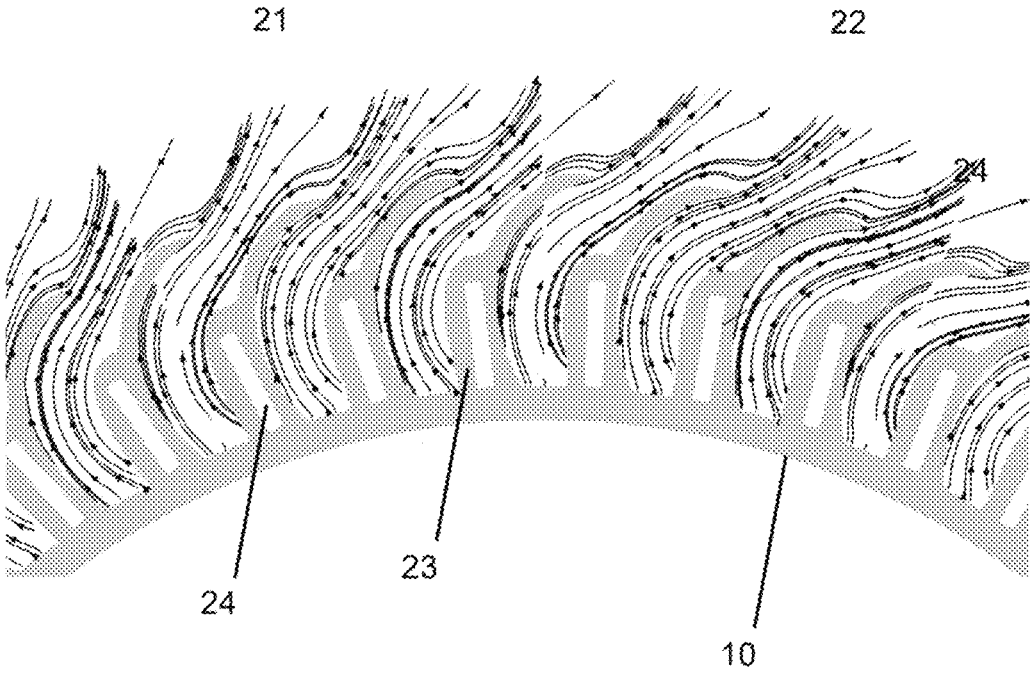
FIG. 6 an eddy diagram of a drum rotor wheel according to the invention.

FIG. 6 shows a flow diagram of a drum rotor wheel 10 according to the invention. Here, the bulge 23 is provided completely in the area 25 of flow separation. If the bulge 23 is only in the area 25 of flow separation, but if it essentially fills it up completely, then eddy formation is almost completely prevented, as can be seen from the eddy arrows, and the efficiency of the drum rotor wheel 10 is optimized.

The use of different materials for the blades 20 is not shown in FIGS. 1 to 6.

The embodiments shown here are only examples of the present invention and therefore must not be construed in a limiting fashion. Alternative embodiments taken into consideration by the person skilled in the art are likewise encompassed by the scope of protection of the present invention.

LIST OF REFERENCE NUMERALS

10 drum rotor wheel
20 blades
21 leading edge
22 trailing edge
23 bulge
24 balancing pocket
25 area of flow separation
30 top disc
31 ring
32 radius-shaped area
33 second balancing pocket
40 bottom disc
41 opening
X axial direction

What we claim is:

1. A drum rotor wheel having numerous short blades that are curved forward, whereby the blades have a leading edge and a trailing edge, a top disc and a bottom disc, characterized in that the drum rotor wheel has at least one blade having a bulge on its leading edge, whereby the bulge is connected to the bottom disc and the bulge is provided completely in the area of flow separation, and the bulge also has a balancing pocket that extends all the way into the bottom disc and passes through it, whereby the top disc has an additional ring on its outside, the inner contour of the additional ring having a radius-shaped area, and whereby the additional ring has at least a second balancing pocket.

2. The drum rotor wheel according to claim 1, characterized in that the bulge is configured so as to be shorter in the axial direction than the axial length of the blade.

3. The drum rotor wheel according to claim 1, characterized in that the balancing pocket extends all the way into the top disc.

4. The drum rotor wheel according to claim 3, characterized in that the balancing pocket passes all the way through the top disc.

5. The drum rotor wheel according to claim 1, characterized in that all of the blades have a bulge.

6. The drum rotor wheel according to claim 1, characterized in that, in the radial direction, the bulge matches the shape of the area of flow separation.

7. The drum rotor wheel according to claim 1, characterized in that radially inwards of the second balancing pocket, the additional ring has a ring-shaped material recess.

* * * * *